United States Patent [19]

Denney

[11] 4,008,632

[45] Feb. 22, 1977

[54] WATCH BAND LINK CONNECTING DEVICE

[75] Inventor: Joe W. Denney, Hays, Kans.

[73] Assignee: Walter Moorhouse, Clear Lake, Minn.

[22] Filed: Nov. 17, 1975

[21] Appl. No.: 632,215

[52] U.S. Cl. ..... 81/3 R; 59/79 R

[51] Int. Cl.[2] ..... B25B 27/22; B21L 21/00

[58] Field of Search ..... 59/7, 79 R, 85; 224/4 B, 4 D, 4 H, 4 K; 63/4; 81/3 R, 6

[56] References Cited

UNITED STATES PATENTS

| | | | |
|---|---|---|---|
| 3,344,599 | 10/1967 | Hauser | 59/79 R |
| 3,736,644 | 6/1973 | Simon | 59/7 |

*Primary Examiner*—Al Lawrence Smith
*Assistant Examiner*—Roscoe V. Parker
*Attorney, Agent, or Firm*—Leo Gregory

[57] ABSTRACT

A tool to connect a pair of watch band link members of a band in which pairs of links are in overlapping relation, each link having a connection member at one end thereof and a channel opening at its other end adjacent the connection member of the other of a pair of said links. Said connecting members and said channel openings being inter-connected. The tool herein carries said pair of link members, holding one link thereof in stationary position and having the other link mounted thereon to be moved thereon in the direction of said first mentioned link, said tool holding the connection members in alignment with their respective adjacent channel openings for simultaneous disposal of said connection members into their respective channel openings.

4 Claims, 6 Drawing Figures

WATCH BAND LINK CONNECTING DEVICE

BACKGROUND AND SUMMARY OF THE INVENTION

It is a common practice to remove and connect links of a link type watch band for repair purposes or for adjustment of the length of the watch band. Representative of the type of watch band referred to herein is the watch band marketed under the trademark Speidel and disclosed in U.S. Pat. No. 2,689,450.

Described generally the watch band referred to herein is a watch band structure made up of adjacent pairs of overlapping tubular links and comprises a pair of superposed layers of links in staggered overlapping relation of adjacent overlying pairs of links.

Each link of the overlying pairs of links has a connection member at one end thereof in longitudinally opposed relation to a like connection member of the other link of said pair of links and a channel opening at each end of said links adjacent the connection member of the other link, said connection members to be disposed simultaneously into their respective adjacent channel openings. Difficulty arises in simultaneously aligning the connection members with their respective adjacent channel opening. This is a time consuming practice. The invention herein greatly simplifies the connection of said links.

There are not known to be any like tools developed in the art.

It is an object of this invention therefore to provide a tool by means of which a pair of links of a link type watch band may be readily connected.

It is another object of this invention to provide a tool of such a configuration that it very readily places into alignment the connecting means of a pair of watchband links for interconnection of said links.

It is a further object of this invention to provide a tool for use in connecting a pair of links of a link type watch band wherein said tool is of unitary construction and has no moveable parts but is arranged and constructed to carry thereon a pair of links and comprises means to engage a pair of the connection members of said links and to hold the same in alignment with a corresponding pair of openings in said links while said links are moved into inter-connecting engagement and said connection members are simultaneously disposed into said openings.

These and other objects and advantages of the invention will be set forth in the following description made in connection with the accompanying drawings in which like reference characters refer to similar parts throughout the several views and in which.

DESCRIPTION OF A PREFERRED EMBODIMENT

Figure 2:
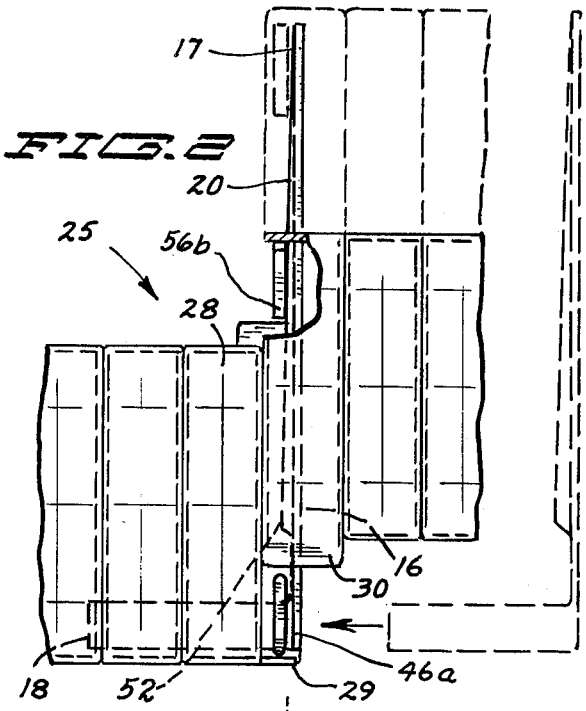
FIG. 2 is a broken view in top plan with a portion thereof in alternate position in dotted line showing an operating position of the device herein.
Figure 1:
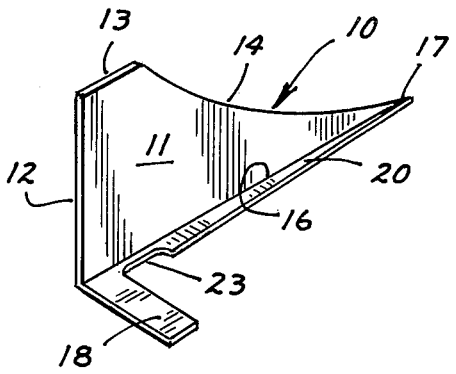
FIG. 1 is a view in perspective of the device herein.

Referring to the drawings, the tool 10 comprises the subject matter of the invention herein.

In the embodiment of the invention here presented said tool comprises a flat plate body portion 11 having a relatively short end edge 12, a straight top edge portion 13 forming a right angle with said end edge and extending to form a concavely curved edge portion 14 which is connected by a straight edge 16 to said end edge 12. Said curved edge terminates in substantially a point 17. Disposed at right angles to said body portion 11 and projecting at right angles therefrom formed as a narrow plate is an arm portion 18.

Extending from said arm portion to the end 17 of said body portion and at right angles to said body portion and of relatively narrow width is a tapered flange 20 forming a wedge, the same tapering substantially to merge into said point 17 at the end of said wall 16 as shown. Adjacent said arm portion, said flange has a portion 23 of reduced width formed as a notch. Said tool is formed preferably of a substantially rigid metal material. It will be understood that the general configuration of said tool may be varied.

A watchband 25 representative of the type herein above indicated in said U.S. Pat. No. 2,689,450, is illustrated to show the application of the device herein.

For the purpose of description herein, said watchband comprises an upper or overlying layer 26 of link members, hereinafter called links, and a lower or overlying layer 27 of links, the links of said upper layer being in a transversely half offset or staggered relation with respect to the links of said lower layer. Referred to are links 28, 29, 30 and 31. Link 28 half overlies the link 29. The link 30 half overlies each of the adjacent underlying links 29 and 31. By way of example, the link 30 is removably attached at each end to the staggered underlying portions of the links 29 and 31 and in this manner, with respect to the other links, the watchband is made up.

The links of particular interest herein and which will be further described in connection with the operation of the device 10 herein are the links 29 and 30.

There is a spacing 35 between the upper and lower layers of links through which a thin plate member may be disposed, as will be described.

Said link 29 will be described as a representative link and comprises a relatively flat tubular body 40 having channel openings 41 and 42 at each end thereof and overlying said channel openings are angled end portions or tabs 43 and 44 which retain in position the connection members to be described.

A U-shaped connection member 46 disposed in horizontal position has one leg **46*a* within a channel of link 30 and its other leg 46*b* within a channel of the adjacent partially underlying link 29. A second connection member identical to the connection 46 in like manner will connect the same end of link 30 with the adjacent partially underlying link 31**. Thus the connection members at each end of a link connect that link to two adjacent underlying or overlying links, as the case may be, the entire flexible band is made up.

The link 30 has a tubular body portion 50 having end channel openings 51 and 52 and tabs 53 and 54 at each end thereof overlying said channel openings. A connection member 56 is shown in FIGS. 5 and 6 carried by said link 30 having leg portions **56*a* and 56*b***.

Figure 3:
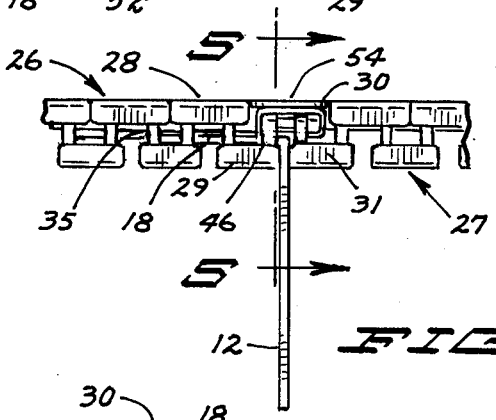
FIG. 3 is a broken view in end elevation.
Figure 4:
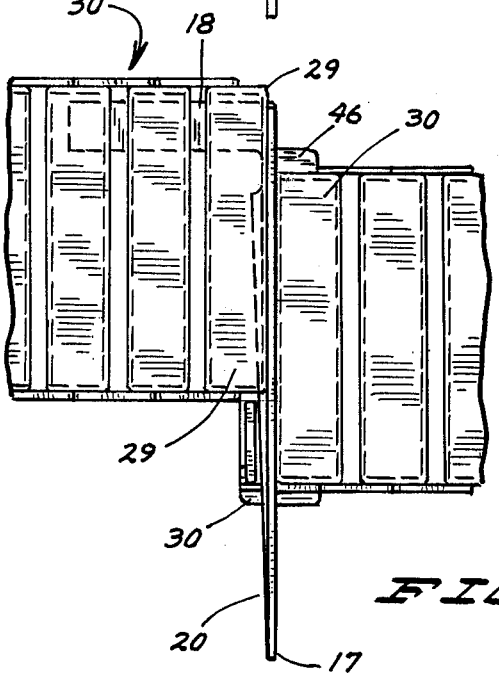
FIG. 4 is a broken view in bottom plan similar to FIG. 2 showing another position thereof.

Referring to the Figures, the device 10 is put into operating position by taking the links 28 and 29 of the watchband in the left hand as viewed in FIG. 3, along with the portion of the watchband to the left thereof. The purpose here will be to connect the link 30 at the other opened end of the watch band to said link 29, which links had previously been disconnected. The link 31 is connected to the link 30 and partially underlies the same as shown. Taking the device or tool in the right hand, it will be held with the body portion 11 disposed downwardly and the tongue portion 18 disposed under the connecting leg 46*a*, as shown in FIG. 5 and into the space 35 between the upper and lower layers of links. The edge 16 and flange 20 will extend longitudinally of the link 29 along the adjacent wall portion of the link 28 and will extend outwardly thereof as shown in FIGS. 4 and 5. The end tab 43 of said link 29 as shown in dotted line will have been bent outwardly horizontally to uncover the channel opening 41.

The tool and the links 28 and 29 are now held in the left hand. Link 30 is taken in the right hand. The tab 54 of said link 30 will have been bent outwardly to uncover the channel opening 52.

Figure 5:
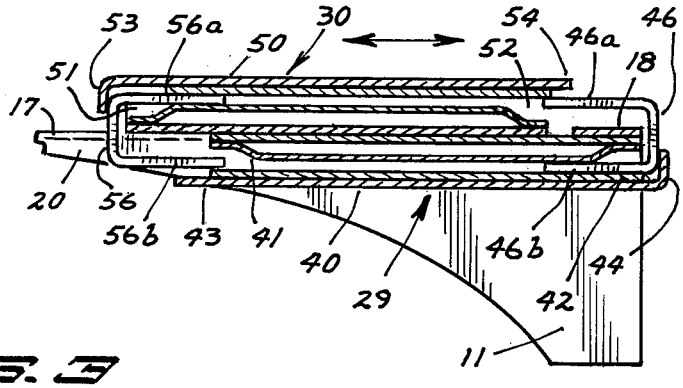
FIG.5 is a view in vertical cross section taken on line 5—5 of FIG. 3 as indicated.
Figure 6:
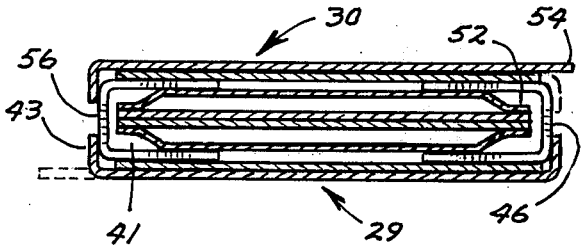
FIG. 6 is a view in cross section similar to FIG. 5.

The link 30 is positioned onto the free end portion 17 and the flange 20 of said tool 10 to ride on the top of said flange is indicated in FIGS. 2 and 5 and the point 17 is disposed at the inner side of the leg 56*b* of the connection member 56. The portion of said link 30 overlying said flange 20 is the portion which when connected will overlie a portion of the link 29 as seen from FIG. 3.

By moving said link 30 along said flange 20 in the direction of the link 29, said flange formed as a wedge urges the leg portion 56*b* outwardly transversely to be in alignment with the channel opening 41. The leg 46*a* of the connection member 46 is held to be in alignment with the channel opening 52 with the initial insertion of the leg portion 18 of said tool transversely of the link 29 as shown in FIGS. 2.

Thus as said link 30 is moved along the flange 20 in the direction of the link 29, said connection leg members will be disposed into said respective channel openings simultaneously. The flange 20 is seen to align said respective channels 41 and 52 to receive the connection members 46 and 56. The tool is removed by bending the link member 30 downwardly at right angles to the link member 28 and the tool is then withdrawn straight outwardly. The tabs 43 and 54 are bent at right angles to overlie their adjacent channel openings. The links of said watchband are thus connected and the connection members are secured in position by their respective tabs.

The tool 10 herein is a very simply devised tool which when put into operation as described permits a very quick assembly or connection of watchband links of the type of a watchband as here indicated. Said tool has proved to be very successful in use.

It will of course be understood that various changes may be made in the form, details, arrangement and proportions of the product and in the steps and sequence of steps of the method without departing from the scope of applicant's invention which, generally stated, consists in a product capable of carrying out the objects above set forth, such as disclosed and defined in the appended claims.

What is claimed is:

1. A tool for use in connecting links of a link type watchband comprising a body portion of substantially rigid sheet material, an elongated arm extending at right angles to one side of said body portion, and a flange in the plane of said arm extending along said body portion, said flange being wedge like of a relatively narrow width and tapering to a point at its free end.

2. The structure set forth in claim 1, including a notch adjacent said arm formed in said flange reducing the width of said flange.

3. The structure set forth in claim 2, wherein said arm is of small thickness.

4. A tool for use in connecting links of a link type watchband comprising a body portion of substantially rigid sheet material, an elongated arm extending at right angles to one side of said body portion, said arm underlying, extending through and holding in a given position a link of said watchband and a link connection member, a flange in the plane of said arm extending along said body portion away from said arm, said flange being of relatively narrow width and tapering substantially to a point at its free end forming a wedge, said flange being disposed to position a connection member of a second link of said watchband, said second link to be connected with said first mentioned link, each of said links has a channel opening therein to receive a corresponding connection member of the other link, said flange aligns upon itself said connection members with their respective channel openings, whereby said second mentioned link is moved into a side by side position adjacent said first mentioned link and said connection members are simultaneously disposed into their corresponding channel openings.

* * * * *